US005505643A

United States Patent [19]

Prasse

[11] Patent Number: 5,505,643

[45] Date of Patent: Apr. 9, 1996

[54] OIL REMOVAL DEVICE FOR OUTBOARD MOTOR

[75] Inventor: William Prasse, Oshkosh, Wis.

[73] Assignee: Brunswick Corporation, Lake Forest, Ill.

[21] Appl. No.: 327,011

[22] Filed: Oct. 21, 1994

[51] Int. Cl.[6] ..... B63H 20/00

[52] U.S. Cl. ..... 440/88; 184/1.5

[58] Field of Search ..... 440/88, 900, 76, 440/77; 123/196 R; 184/1.5, 6–13

[56] References Cited

U.S. PATENT DOCUMENTS 2,911,937 11/1959 Kiekhaefer ..... 440/77
3,033,311 5/1962 Edgar et al. ..... 184/1.5

FOREIGN PATENT DOCUMENTS 1029338 5/1966 United Kingdom ..... 440/88

OTHER PUBLICATIONS

"Honda Marine Shop Manual, Outboard Motor, BF35A/BF45A" ©1991 Honda Motor Co., Inc.

*Primary Examiner*—Sherman Basinger
*Attorney, Agent, or Firm*—Wood, Phillips, VanSanten, Clark & Mortimer

[57] ABSTRACT

A device to facilitate removal of oil from an outboard motor having an oil tank located in its drive shaft housing. An oil removal tube fitted in a bore through the adapter plate of the motor extends downwardly to the bottom of the oil tank and projects above the adapter plate and terminates inside the cowling for the motor. The top of the tube may be threaded to accept a connector to an oil removal pump.

15 Claims, 2 Drawing Sheets

OIL REMOVAL DEVICE FOR OUTBOARD MOTOR

FIELD OF THE INVENTION

The invention is in the field of outboard motors, and more particularly to equipment for removing oil from outboard motors having an oil reservoir in the drive shaft housing.

BACKGROUND OF THE INVENTION

Traditionally, outboard motors utilize two cycle power heads that ran on a mixture of gasoline and oil. Recently interest has expanded in four cycle power heads which utilize separate sources of fuel and oil held in separate storage tanks. One option is to provide an oil storage area located within the drive shaft housing of the motor.

One problem overcome by the invention is the difficulty of removing oil from the storage area in the drive shaft housing. As the bottom of the storage area is low on the drive shaft housing, a drain plug at the bottom of the oil storage area will be difficult to reach when the motor is on a boat. The plug will also be near the water. Both of these conditions make it difficult to drain the oil from the engine and promote oil spills during the draining process.

The primary advantage of the invention is that it overcomes the draining problem by permitting removal of oil from the motor from a position adjacent to the power head of the motor which is readily accessible even with the motor attached to a boat.

A further advantage of the invention is that it may also support a dip stick for measuring the amount of oil in the oil storage area.

SUMMARY OF THE INVENTION

The invention comprises a device for removing oil from an outboard motor having a power head, a cowling for the power head, a drive shaft housing having an oil storage area therein and an adapter plate between the power head and the drive shaft housing. A tubular means for removing the oil from the oil storage area extends downwardly through the adapter plate terminating adjacent to the bottom of the oil storage area. An upper end of the tubular means comprises means for connecting the upper end to means for pumping the oil from the oil storage area.

In the preferred embodiment of the invention, the aforesaid tubular means is a rigid metal tube which is press fitted into a receiving bore extending through the adapter plate. A raised ridge on the tube may be provided as a stop to position the tube upon insertion through the adapter plate.

The top of the oil removing tube may be expanded and provided with a fitting adapted for connection to a pump suitable for withdrawing the engine oil from its reservoir in the drive shaft housing. In one embodiment this end fitting may be a male threaded portion suitable for connection to a garden type hose. In another, it may simply constitute a raised shoulder suitable for retaining a rubber collar that may be slipped thereover. A cap adapted to fit the connection at the top of the tube, closes the tube to prevent oil from splashing out.

The oil removal tube may also function as a retainer for a dip stick used to measure the quantity of oil in the oil storage area in the drive shaft housing. Although prior art dip sticks may be adapted for this purpose, the dip stick should preferably close the top of the oil removal tube when inserted to its resting position.

In one preferred embodiment of the invention, the oil removal tube extends upwardly above the adapter plate and into a position beneath the cowl for the engine, so that it is readily accessible when the cowl is removed.

DETAILED DESCRIPTION OF THE PREFERRED EMBODIMENT

Figure 1:
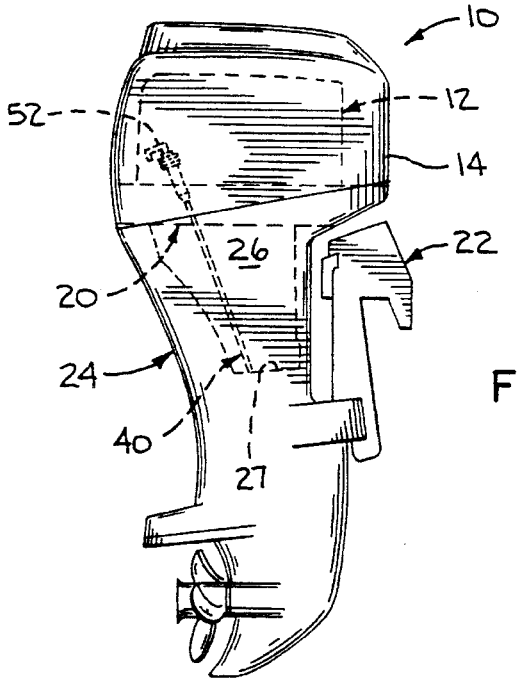
FIG. 1 is a side elevation of an outboard motor showing in schematic phantom the power head, the adapter plate, the oil storage area in the drive shaft housing and an oil removal tube of the invention.

Referring to FIG. 1, an outboard motor 10 is illustrated including the engine cowl 14 and a drive shaft housing 24. Illustrated schematically are the engine power head 12, an adapter plate 20, an oil storage area 26 in the drive shaft housing and an oil removal tube 40 and oil measuring dip stick 52.

It is common in outboard motor construction to utilize an adapter plate 20 to join the power head 12 and the engine cowl 14 to the drive shaft housing 24 and the associated mounting bracket 22 for the motor 10. The power head 12 and drive shaft housing 24 are securely fastened to the adapter plate 20 and the engine cowl 14 is removably supported by the adapter plate 20 or a lower cowl section (not shown) by suitable quick release devices know to the art.

Figure 2:
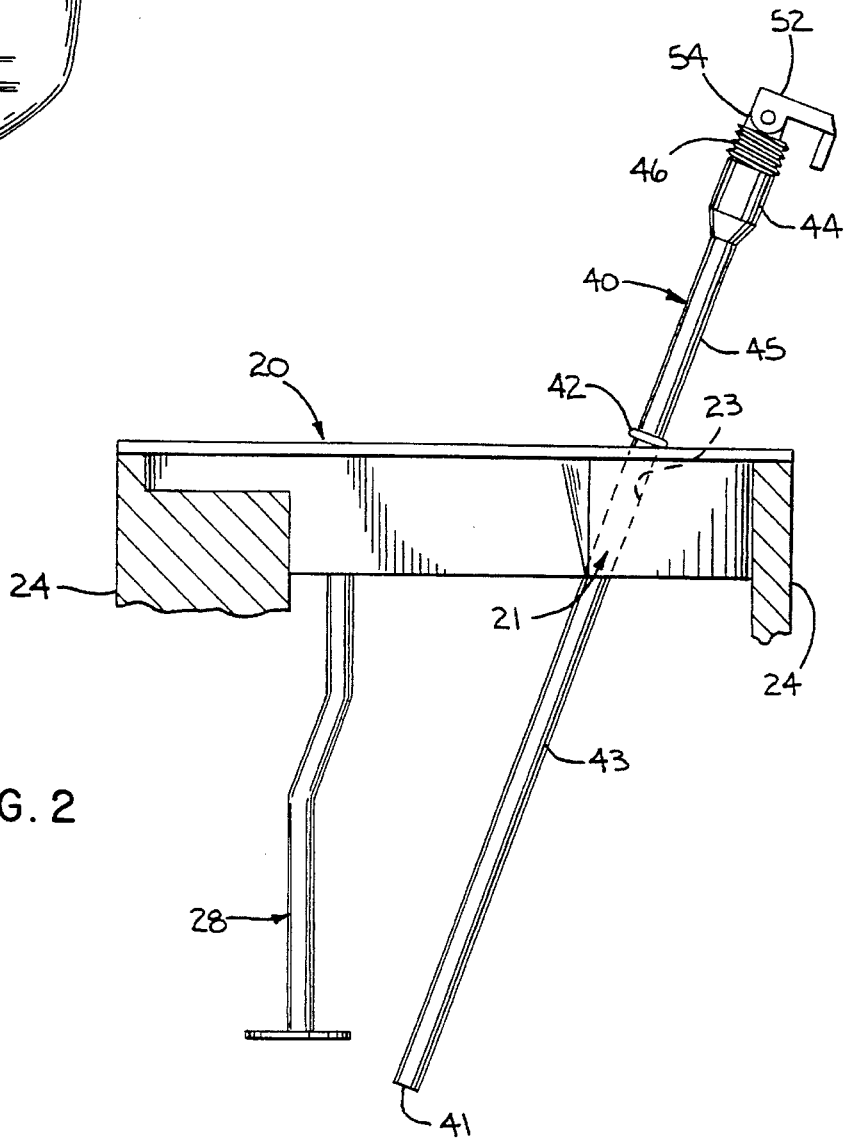
FIG. 2 is a side elevation of a schematic adapter plate for the outboard of FIG. 1 with an engine oil intake for the power head and an oil removal tube of the invention.

The drive shaft housing 24 of the motor 10 is typically made of cast aluminum. When a four cycle power head is employed, it is not unusual to incorporate an oil storage area or reservoir 26 in the casting of the housing; alternatively, a separate oil tank located within the drive shaft housing may be used. Oil for the power head is drawn from the reservoir 26 through a tube 28 as illustrated in FIG. 2 which extends well into the oil reservoir 26. Typically the oil drains from the power head 12 back into the reservoir 26 by suitable passages (not shown) through the adapter plate 24.

FIG. 2 is a schematic view of an adapter plate 24 of an outboard motor with an oil removal tube 40 of the invention assembled thereto. A bore 21 is provided in the adapter plate 24 and the tube 40 is inserted therethrough and secured in its operating position with its lower end 41 almost touching the bottom 27 of the oil storage area 26 (See FIG. 1).

The tube 40 is preferably press fitted into the bore 21 through the adapter plate 24. An annular stop 42 provided on the tube 40 functions to limit the extension of the tube 40 through the adapter plate 24 and so position its lower end 41 with respect to the bottom 27 of the oil reservoir 26.

Figure 3A:
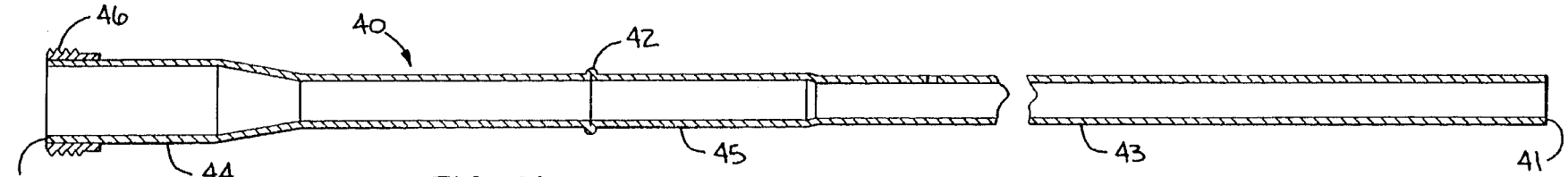
FIG. 3A is a longitudinal cross-sectional view of the preferred embodiment of the oil removal tube of the invention.

FIG. 3A illustrates the construction of one embodiment of the tube 40. The tube 40 is divided into three sections of different diameters. The mid-section 45 is 0.50 inches in diameter and is sized to be press fitted into its receiving bore 21 through the adapter plate 24. The lower end 43 of the tube 40 is 0.46 inches in diameter, being smaller in order to closely retain the dip stick so that it does not rattle. The upper end 44 of the tube 40 is flared so that the end fitting 46 will be large enough to fit a common garden hose or available hand pump 60 and to accommodate a locking expanding head of the dip stick 52. The tube 40 is preferably made of aluminum or steel and has a wall thickness of between 0.03 and 0.06 inches. The threaded end piece 46 is preferably made of brass or aluminum and may be press fitted or brazed onto the upper end 47 of the tube 40.

Figure 3B:
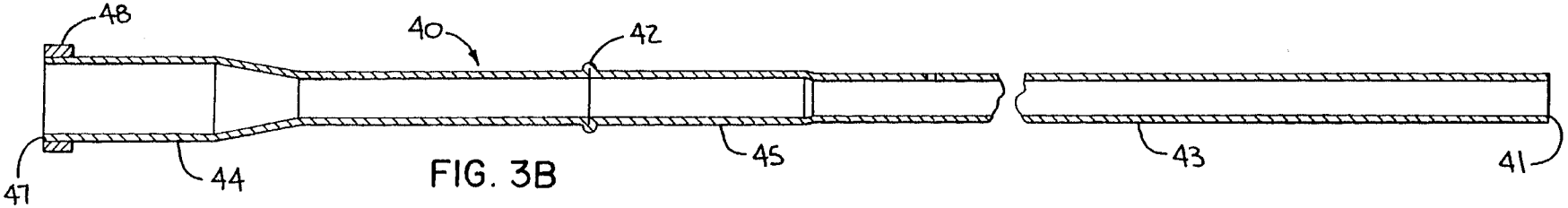
FIG. 3B is a longitudinal cross-sectional view of an alternate embodiment of the oil removal tube of the invention.

FIG. 3B illustrates an alternative construction at the end 47 of the tube 40. Instead of a threaded section as illustrated in FIG. 3A, the end 47 of the tube is simply provided with an expanded collar 48 which may be integral with the tube 40 or attached thereto by suitable means.

Figure 4A:
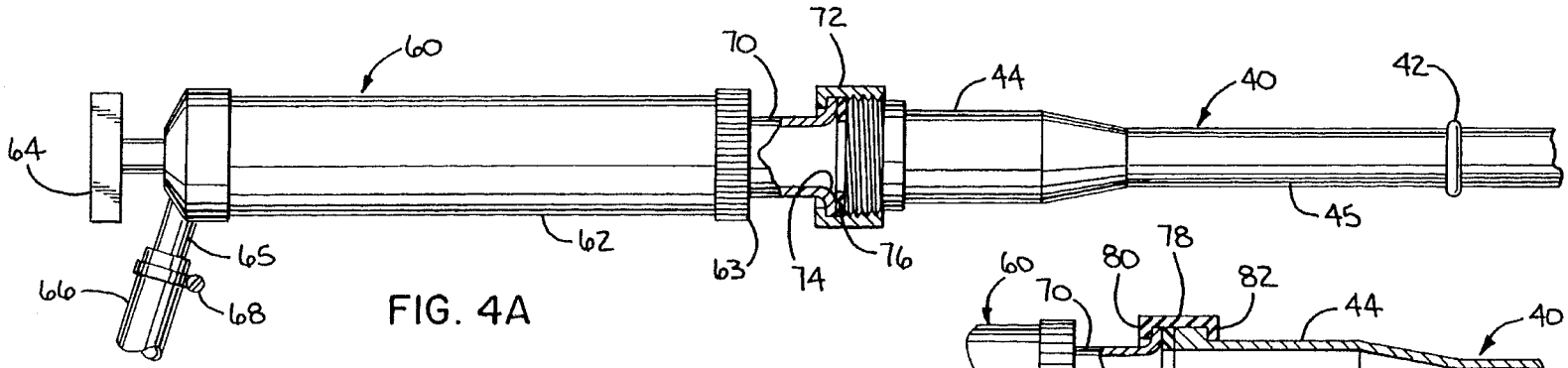
FIG. 4A is a side elevation, partially in cross section, of the upper end of the oil removal tube of FIG. 3A connected to a female threaded end fitting of an oil removal pump.

FIG. 4A illustrates the tube of FIG. 3A attached to a hand pump 60 of a type available on the open market. The pump 60 has a rigid tubular body 62 which houses a common plunger (not shown). The inlet end 63 of the pump 60 may be modified to provide a flexible intake section 70 extending therefrom and terminating in a flange 74 which retains thereon a female threaded sleeve 72 of standard dimension, such as a garden hose, which mates with the threaded end fitting 46 on the tube 40. A rubber washer 76 positioned between the end 47 of the tube 40 and the flange 74 serves to seal the pump intake section 70 to the oil removal tube 40.

Figure 4B:
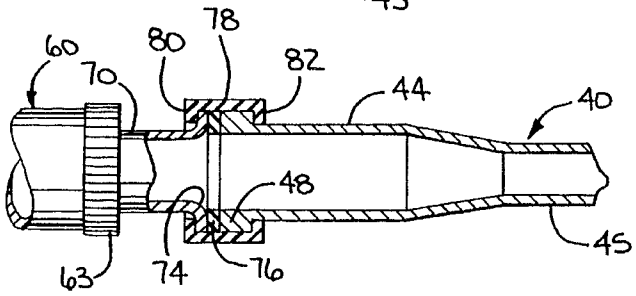
FIG. 4B is a partial side elevation, partially in cross section, of the upper end of the tube of FIG. 3B connected by rubber sleeve to an end fitting on an oil pump.

FIG. 4B illustrates an alternative device for connecting the upper end 47 of the tube 40 to the pump 60. Instead of mating threaded members 46 and 72, as shown in FIG. 4A, a "U" shaped rubber sleeve 78 is employed to join the tube 40 and the pump inlet tube 70. The upper lip 80 of the sleeve 78 fits tightly around the body of the pump inlet tube 70 and against the flange 74 at the end of tube 70.

In operation, the rubber sleeve 78 expands to accept the upper end 47 of the tube 40 and the collar 48. The sleeve 78 fits snugly about the collar 48 and its lower lip fits over the collar 48 and holds the pump 60 to the tube 40. A rubber gasket 76 positioned between the top 47 of the tube 70 and the flange 74 may be used to help seal the junction.

Movement of the plunger handle 64 pumps oil from the reservoir 26 up through the pump body 62 and out through the discharge duct 65 adjacent to the upper end of the pump 60. A hose 66 secured to the discharge duct 65 by a clamp 68 may be used to direct the oil exiting the pump 60 to a disposable container.

Positioned as illustrated in FIGS. 1 and 2, the oil removal tube 40 extends above the adapter plate 20 but inside the cowl 14, so that it is easily accessible from a boat to which the motor 10 is attached by its transom bracket 22. The pump 60 may be connected to the tube 40 and the oil pumped out of the reservoir 26 by a person positioned within the boat without danger of the oil being spilled into the water, thus avoiding an environmental hazard.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an outboard motor having a power head, a drive shaft housing, a substantially planar adapter plate positioned between and attached to the head and the housing, a cowling separate from the adapter plate covering the power head and the adapter plate, and an oil storage area in the drive shaft housing, an improvement comprising:

tubular means extending through the adapter plate and projecting therebelow into the oil storage area for conducting oil out of the oil storage area, said tubular means being comprised of a tubular body having an upper end, a mid section and a lower end terminating adjacent to the bottom of the oil storage area;

means for retaining the tubular body in a fixed position within the adapter plate; and means for connecting the upper end of the tubular means to a means for causing oil to flow out of the oil storage area through the tubular means.

2. The device of claim 1 wherein said tubular body is a rigid tube.

3. The device of claim 2 wherein the adapter plate has a bore therein sized to receive the rigid tube and wherein the means for retaining the rigid tube in a fixed position comprises an enlarged mid section of the tube and a friction fit of the enlarged mid section of the tube within the bore.

4. The device of claim 3 wherein the tube comprises annular means protruding from the mid section of the tube for limiting the extension of the tube into the bore through the adapter plate.

5. The device of claim 2 wherein the upper end of the tube terminates above the adapter plate.

6. The device of claim 1 wherein said connecting means comprises a threaded area at the upper end of the tube.

7. The device of claim 6 wherein the upper end of the tube is enlarged so that the outside diameter of the threaded area is larger than the outside diameter of the mid section and lower end of the tube.

8. The device of claim 1 further comprising a dip stick means for measuring the amount of oil in the oil storage area and wherein the tubular means comprises a housing for the dip stick.

9. The device of claim 1 wherein the upper end of the tubular body terminates inside the cowling covering the power head.

10. The device of claim 1 wherein the means for causing oil to flow out of the oil storage area comprises a pump comprised of a flexible inlet tube and a fitting at the end of the inlet tube adapted to mate with the upper end of the tubular means for conducting oil out of the oil storage area.

11. In an outboard motor having a power head, a drive shaft housing, an oil storage area within the drive shaft housing, adaptor plate means for attaching the power head to the drive shaft housing, said adapter plate positioned on top of the drive shaft housing and an engine cowling enclosing the power head and adapter plate, an improved means for removing oil from the oil storage area in the drive shaft housing comprising:

a rigid tube extending from a selected position above the adapter plate through the adapter plate to a position below the adapter plate adjacent the bottom of the oil storage area; and means for maintaining the tube in a fixed position relative to the adapter plate, the tube and means for maintaining the tube in a fixed positioning being separate and apart from the drive shaft housing.

12. The improvement for the outboard motor of claim 11 wherein the means for maintaining the tube in a fixed position relative to the adapter plate comprises a bore extending generally vertically through the adapter plate, a portion of the tube being enlarged, the enlarged portion of the tube being press fitted into the bore.

13. The improvement of the outboard motor of claim 12 wherein the tube comprises means protruding laterally therefrom for engaging the adapter plate and thereby limiting the travel of the tube into the bore.

14. The improvement of the outboard motor of claim 12 wherein the tube is comprised of a lower portion extending within the drive shaft housing and terminating adjacent the bottom of the oil storage area, a mid section residing in part within the adapter plate, and an upper section extending above the adapter plate, wherein the diameter of the lower portion of the tube is smaller than the diameter of the mid section so as to pass easily through the bore in the adapter plate.

15. The improvement of claim 14 wherein the upper section of the tube is enlarged, threaded and sized to mate with a common garden hose.

* * * * *